US005219257A

United States Patent [19]

Koch

[11] Patent Number: 5,219,257

[45] Date of Patent: Jun. 15, 1993

[54] SELF-OPENING CAN LID WITH IMPROVED CONTOUR OF SCORE AND MEANS FOR MAKING

[75] Inventor: Douglas F. Koch, Springboro, Ohio

[73] Assignee: Koch Systems Incorporated, Dayton, Ohio

[21] Appl. No.: 786,065

[22] Filed: Oct. 31, 1991

Related U.S. Application Data

[62] Division of Ser. No. 616,984, Nov. 21, 1990, Pat. No. 5,064,087.

[51] Int. Cl.[5] ..... B21D 37/00; B21D 51/38

[52] U.S. Cl. ..... 413/67; 413/17; 72/325

[58] Field of Search ..... 413/12, 16, 17, 62, 413/67; 72/325

[56] References Cited

U.S. PATENT DOCUMENTS

| | | | |
|---|---|---|---|
| 3,688,718 | 9/1972 | Schrecker | 413/12 |
| 3,967,752 | 7/1976 | Cudzik | 220/269 |
| 4,084,721 | 4/1978 | Perry | 220/269 |
| 4,354,784 | 10/1982 | Westphal | 413/67 |

*Primary Examiner*—Bruce M. Kisliuk
*Assistant Examiner*—Jack Lavinder
*Attorney, Agent, or Firm*—Killworth, Gottman, Hagan & Schaeff

[57] ABSTRACT

An easy-open container end includes a displacable panel defined by a score line having curved tails which is in parallel relationship with adjacent means for reinforcing, thereby reducing opening failures, while controlling tearing. A score die and anvil is further provided wherein a four bolt pattern provides greater resistance to distortion and more even mounting stress distribution, resulting in more even score line residuals and reduced opening failures.

11 Claims, 10 Drawing Sheets

SELF-OPENING CAN LID WITH IMPROVED CONTOUR OF SCORE AND MEANS FOR MAKING

This is a division of application Ser. No. 07/616,984 filed Nov. 21, 1990 now U.S. Pat. No. 5,064,087.

BACKGROUND OF THE INVENTION

The present invention relates to easy-open container ends, in particular to the design of rupturable score lines which define a panel displacable by action of an opening tab. The present invention further relates to an improved die design for making score lines of improved design in such container ends.

Easy-open containers are well known in the beverage industry, and typically comprise a two-piece construction consisting of a container body and a container end. The container body and container end are typically made of thin gauge aluminum and joined to withstand internal pressures commonly associated with carbonated beverages.

Various easy-open features have been incorporated in container end walls. In a typical configuration, an opening tab attached to a container end wall may be rotated to exert axial pressure and displace a panel or tongue defined by rupturable score lines. The rupturable score lines are stamped into container end walls by score die sets of mating score dies and anvils. The rupturable score lines typically involve tight manufacturing tolerances because material thicknesses generally range in thousandths and ten-thousandths of inches. Thus, while rupture of the score line is desired, sufficient score line residual must remain to resist the internal container pressures. A typical score line design and container end known in the prior art are shown in FIGS. 1 and 2.

As production continues, score lines become weaker with die wear, and score line residual increases. Opening failures result with greater frequency as tearing and separation of the panel from the container end wall along weaker score lines stops prematurely. Score line residual array also be undesirably effected by factors other than die wear. Typically, score dies and mating anvils used to stamp score lines are mounted by three bolts to equipment at a stamping station. Uneven draw upon or overtorquing of the mounting bolts may cause distortion in the die or anvil surfaces.

In addition to the score line residual, rupture along the score line is typically facilitated by providing reinforcement of the container end wall and panel. To provide support and stiffness thereto, means for reinforcing, such as raised beads (also known as ribs or beams), and raised areas on the container end wall and panel are pressed into the material of the container end. The need for, and design of the various known means for reinforcing will vary depending upon the material thickness used.

It remains, however, that opening failures in easy-open container ends continue to occur with unacceptable frequency with known designs. Accordingly, further improvements are needed to decrease container opening failures and improve the operation of dies used to stamp score lines in container ends for easy-open containers.

SUMMARY OF THE INVENTION

The present invention meets those needs by providing an easy-open container end of improved design. A rupturable score line is designed to extend between first and second ends to define a panel. The panel is preferably curved or oval-shaped. An unscored hinge area remains between the first and second ends, connecting the panel to the end wall. The rupturable score line of the present invention is designed to extend substantially parallel to means for reinforcing the end wall, such as two raised beads pressed symmetrically about the panel, where adjacent to such means. Such parallel relationship eliminates an area of metal between the score line and beads, which area may be observed to bend rather than tear, contributing to opening failures. Thus, the parallel relationship between the score line and means for reinforcing enhances the rupture of the score lines upon opening, reducing opening failures.

The score line of the present invention further includes first and second tails disposed, respectively, on the first and second ends of the score line. The tails are curved inward towards the hinge area. In addition, the score line is extended to displace the second tail further up the adjacent bead. These improvements serve to control and limit the tearing of material in the hinge area during opening, enhancing the useful hinge area while reducing opening failures.

Further, in accordance with the present invention the parallel relationship between the score line and the means for reinforcing proximate thereto, permits changes to be made in the thickness of container end wall materials without changing the score line design. As a result, reduced tooling, design and manufacturing changeover time is needed to effect such changes in the manufacture of container ends.

The die means for forming the score line of the present invention, a die set, includes a score die and mating anvil. The score die of the present invention has a generally planar die face and is attached by four bolts to means for operating the die. The use of four bolts permits smaller bolt diameters and thus requires smaller bolt holes to be drilled in the die face. More metal may thereby remain in the die face, strengthening the die. The use of four bolts permits more even distribution of pressure across the die face. Distortion of the die face is reduced, resulting in a more even score line residual and more uniform depth of score. The die face further includes a raised scoring edge embodying the score line design of the present invention, and preferably includes depressions to accommodate means for reinforcing the end wall. Means for reinforcing, such as raised beads, may be formed in the container end wall or panel prior to scoring or, as is preferred, formed at least in part, during scoring by cooperation between the score die and anvil. A raised bead or area formed in the panel during scoring also serves to take up metal displaced by scoring the container end wall.

The anvil of the present invention is also attached by four bolts to means for operating the anvil, again to retain metal in the anvil to strengthen the anvil and permit more even distribution of pressure across the face thereof. Distortion and variation in the anvil are prevented, resulting in more even and uniform score line residual. The anvil further includes raised anvil areas against which the raised scoring edge of the score die operates to score the container end wall.

Accordingly, it is an object of the present invention to reduce opening failures, enhance and preserve the hinge area connecting panels to container end walls, and provide a score line design which need not be changed upon change in material designs. It is also an object of the present invention to provide an improved score die and anvil capable of producing uniform and even score lines. It is a further object of the present invention to provide a score die and anvil having a design embodying characteristics necessary to produce the score line and related means for reinforcing of the present invention.

DETAILED DESCRIPTION OF THE PREFERRED EMBODIMENT

Figure 3:
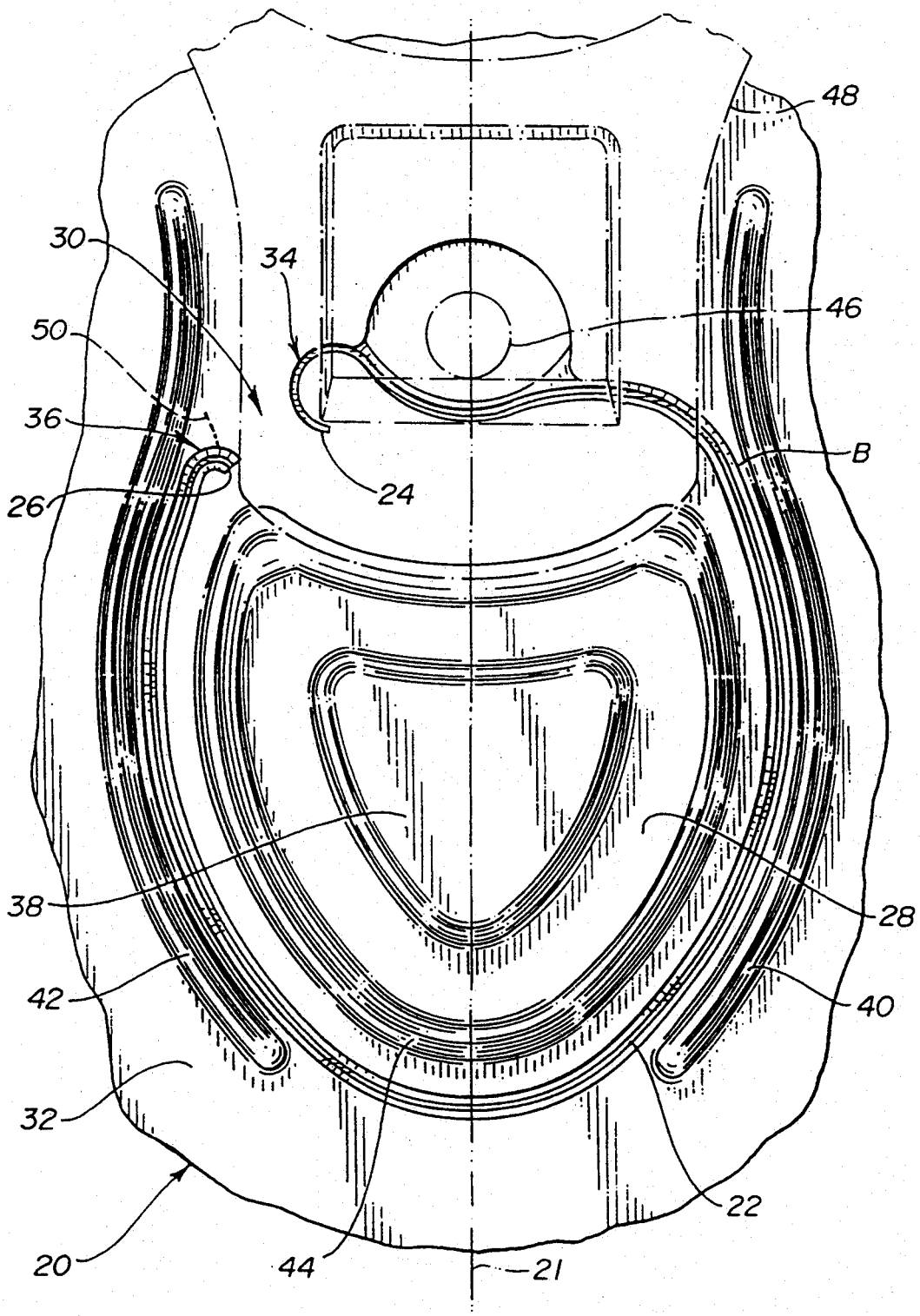
FIG. 3 is a schematic diagram of the container end showing the improved score line of the present invention.

Referring to FIG. 3, the score line 22 of the present invention is shown as it would appear on container end 20. Score line 22 extends between first end 24 and second end 26, defining oval-shaped panel 28. Unscored hinge area 30 connects panel 28 to container end wall 32. First tail 34 and second tail 36 are shown curving inward towards hinge area 30 and towards the central portion of panel 28. Container end 20 is stiffened by means for reinforcing including at least one bead, or as is preferred, first and second beads 40, 42, respectively, symmetrically disposed about panel 28. Means for reinforcing further include raised panel area 38 and panel bead 44. As shown in FIG. 3, score line 22 and beads 40, 42 are in substantially parallel relationship where beads 40, 42 are proximate to score line 22. Of particular significance in the present invention is that segment of score line 22 which remains parallel to second bead 42 as score line 22 approaches second tail 36. Maintenance of this parallel relationship enhances rupture and reduces opening failures. In addition, score line 22 extends further along second bead 42 relative to prior art designs to further substantially prevent tearing of end wall 32.

Figure 1:
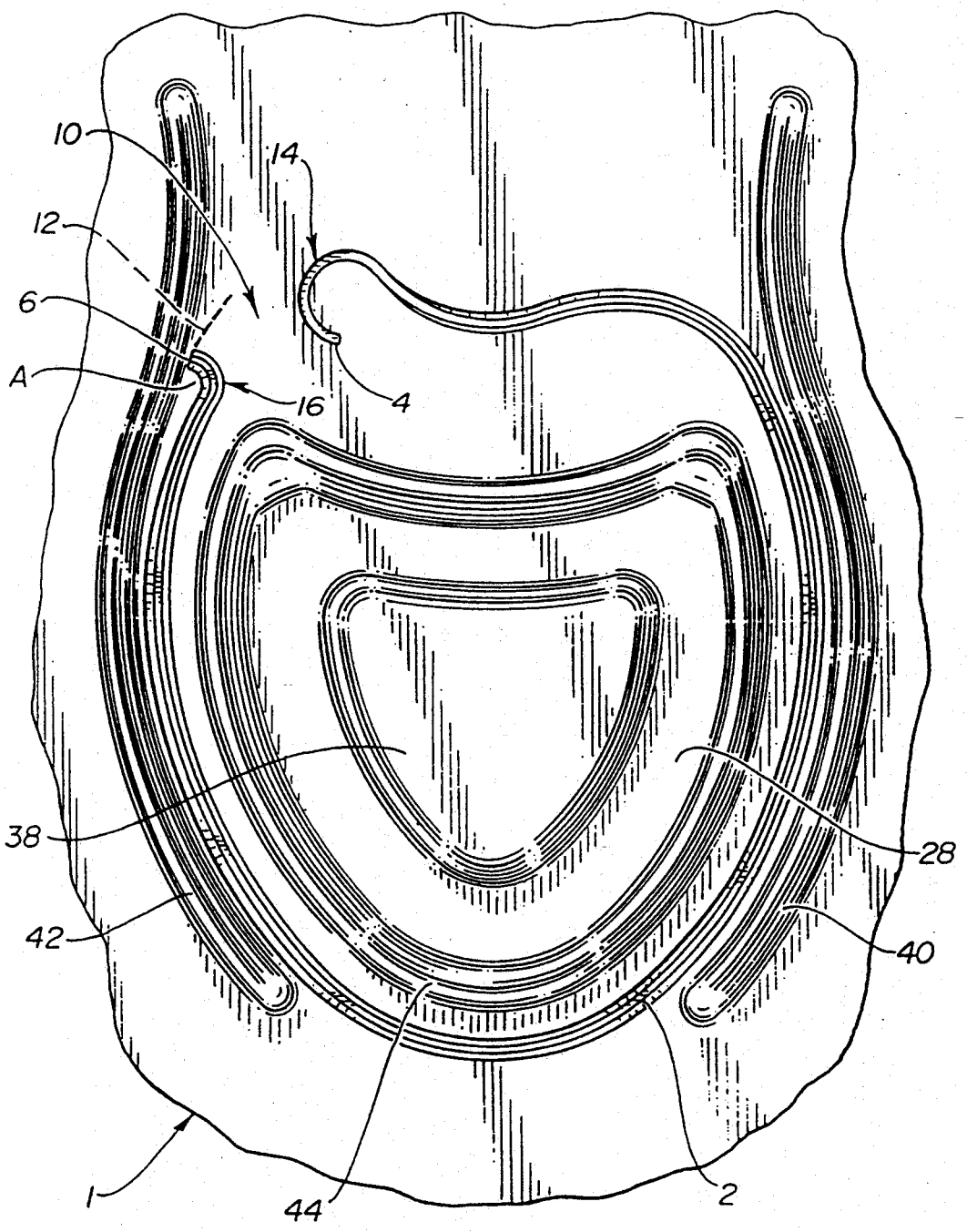
FIG-1 PRIOR ART
FIG. 1 is a schematic diagram of a container end showing a score line design known in the prior art.
Figure 2:
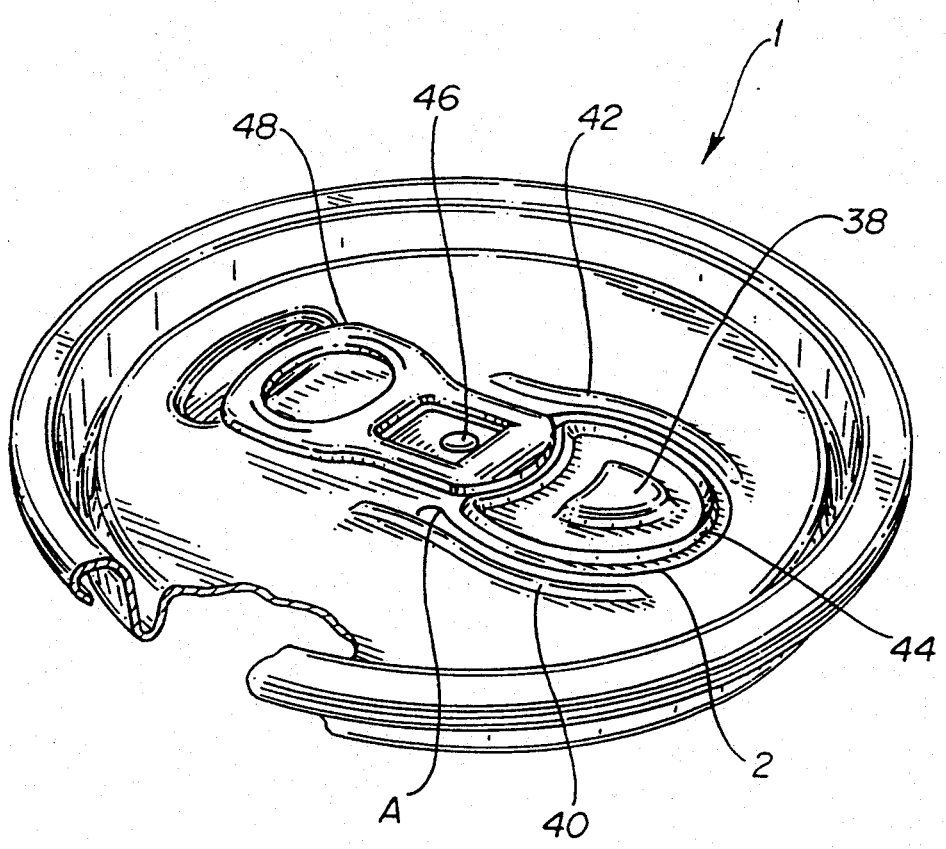
FIG-2 PRIOR ART
FIG. 2 is a schematic perspective of a container end known in the prior art.

Referring to FIGS. 1 and 2, where like numbers indicate like elements, container end 1, as known in the art, shows score line 2 having first and second ends 4, 6, which include first and second tails 14, 16, respectively, of known design. Container end 1 is stiffened by means for reinforcing including first and second beads 40, 42, respectively, raised panel area 38 and panel bead 44. In contrast to the present invention, score line 2 may be seen to diverge inward from parallel relationship with second bead 42 before turning outward in second tail 16. The presence of area A between bead 42 and score line 2 inhibits rupture of score line 2 in prior art container ends. The material in area A tends to bend, rather than resist, and thus contributes to opening failures. Further, tearing associated with opening along score line 2 tends to propagate into and reduce the effective hinge area 10 of container end 1, as indicated at 12. A typical cross-section of container end 1 as known in the art is shown in FIG. 2.

Referring again to the present invention shown in FIG. 3, rupturable score line 22 extends from first end 24 below means for attaching, such as rivet 46, which secures opening tab 48 to container end wall 32. Score line 22 then continues in a generally oval shape to second end 26 disposed short of first end 24. Preferably, score line 22 is substantially symmetrical about the major axis 21 of panel 28 thus defined. In particular, the segment of score line 22 extending from second end 26 to the corresponding position B laterally across the panel, as shown, is substantially symmetrical. This segment includes that portion of the score line which is adjacent to means for reinforcing the container end wall and is, in accordance with the present invention, substantially parallel to such means where they are proximate to the score line 22. This relationship promotes rupture of score line 22, and reduces opening failures.

Still referring to FIG. 3, first and second tails 24, 26 are curved inward towards hinge area 30 and panel 28. Preferably, first tail 24 curls more than 180 degrees inward, while second tail 26 curls more than 90 degrees inward. This arrangement enhances and preserves the available hinge area 30. Any tearing propagated beyond score line 22, which is unlikely, will tend to deviate outward, as indicated at 50.

Figure 4A:
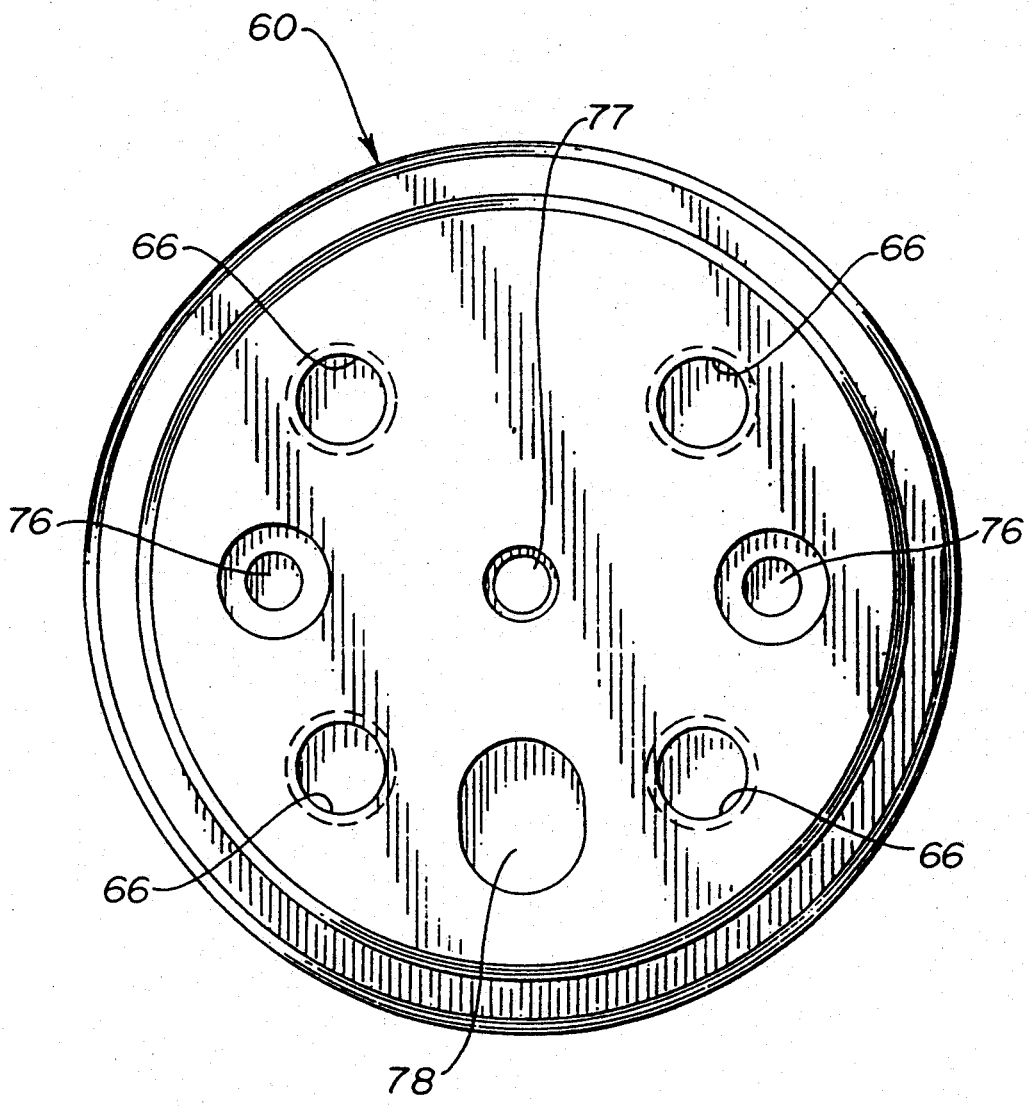
FIG. 4A is a schematic top view of the score die of the present invention.
Figure 4B:
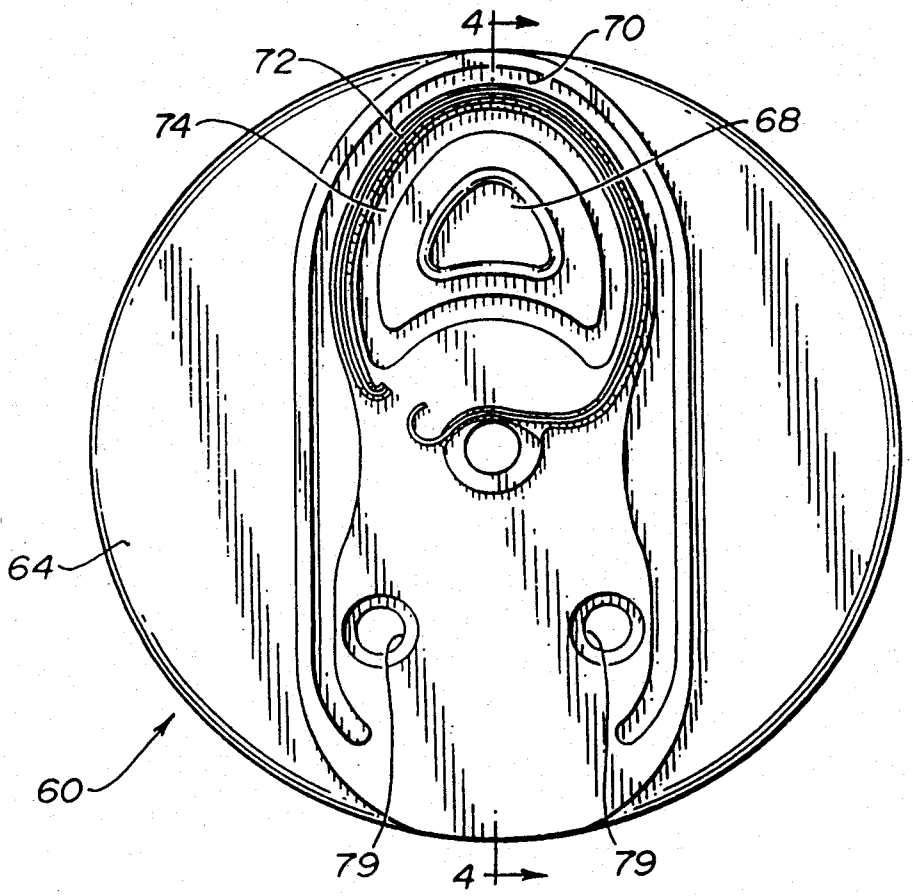
FIG. 4B is a schematic bottom view of the die of the present invention, showing the die face and raised scoring edge thereon.
Figure 4C:
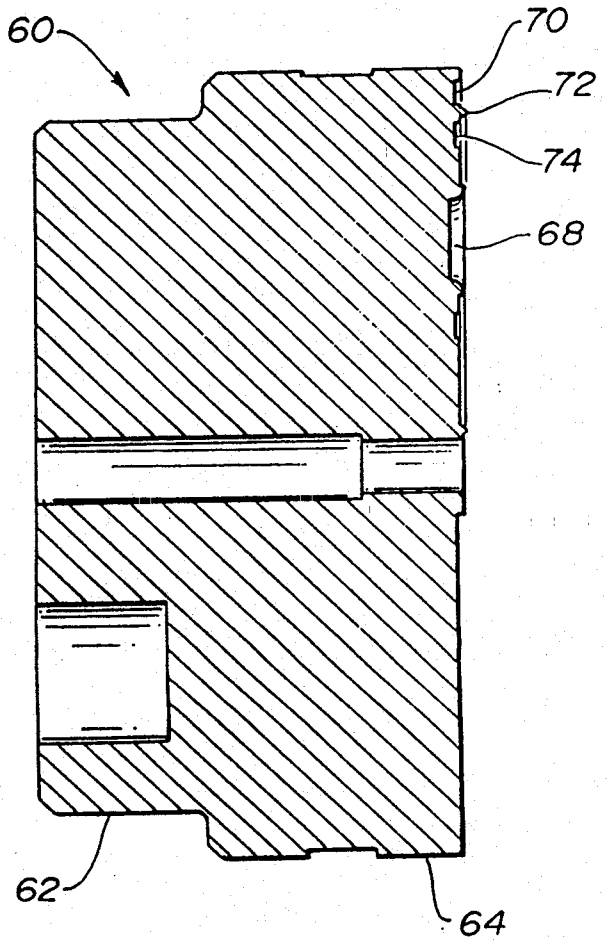
FIG. 4C is a schematic cross-sectional view of the score die of the present invention taken along line 4—4 of FIG. 4B.

With reference to FIGS. 4A-4C, the score die 60 of the present invention is shown. Score die body 62 has a generally planar die face 64 and includes four bolt holes 66 for mounting to means for operating, such as a press (not shown) as known in the art for use at a stamping station. Score die body 62 further includes raised scoring edge 72, which has a profile corresponding to score line 22, and depressions 68, 70 and 74 which correspond with and accommodate raised panel area 38, beads 40 and 42, and panel bead 44, respectively. Shown in FIG. 4A, two alignment holes 76 are provided for insertion of dowels (not shown) used to align score die 60 on means for operating. Reference groove 78 is further provided to assist in properly orienting score die 60. Rivet aperture 77 is centrally located in the score die to accommodate the upward extension of rivet 46 which may be inserted in the workpiece. As seen in FIG. 4B, one or more dimples 79 may also be formed in score die 60 to assist in locating opening tab 48 during manufacturing. Beads 40, 42 and 44 are stamped into container end wall 28 by other dies at preceding stations in the manufacturing process.

Figure 5A:
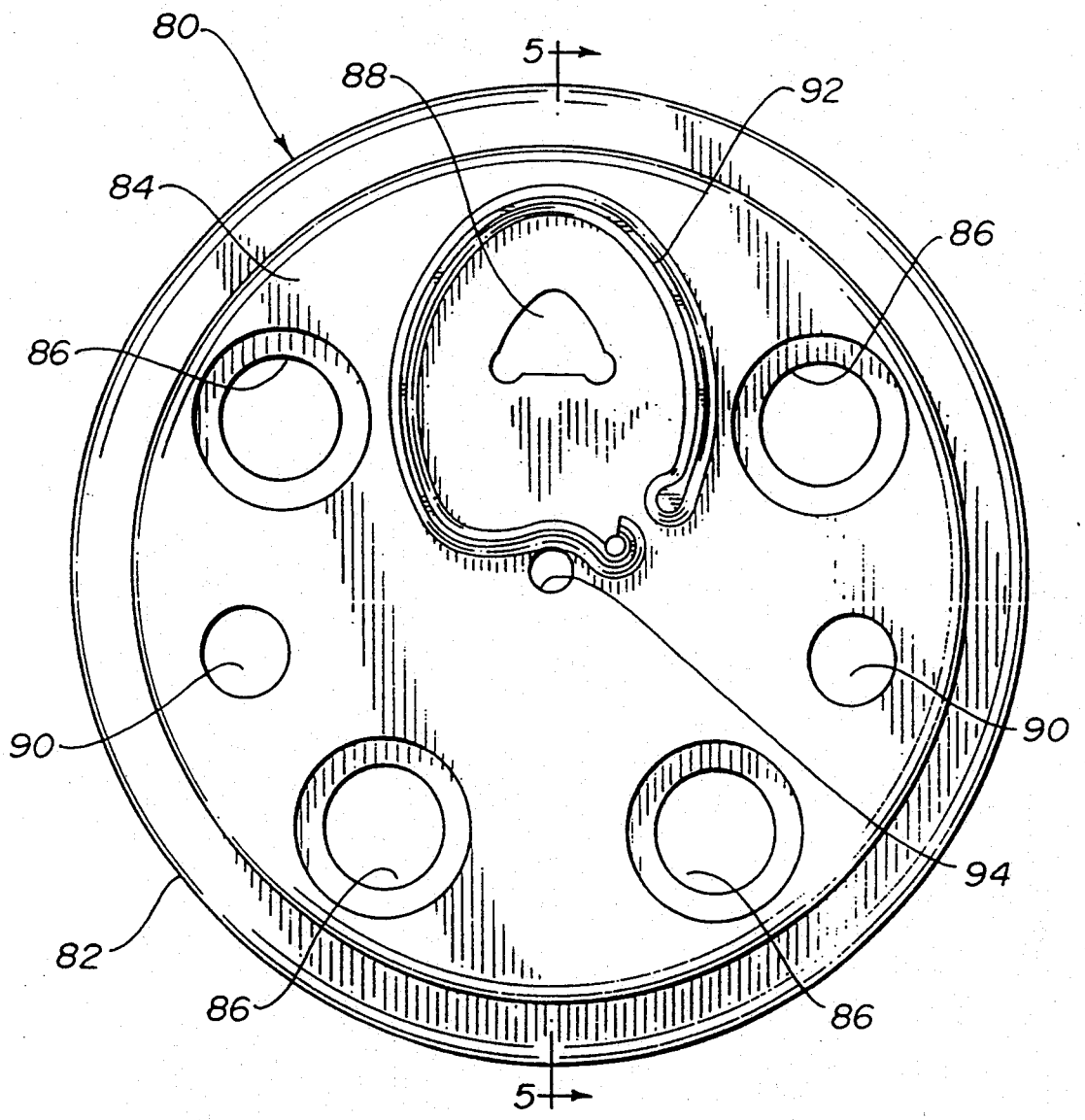
FIG. 5A is a schematic top view of the anvil of the present invention, showing the anvil face and raised score line anvil area thereon.
Figure 5C:
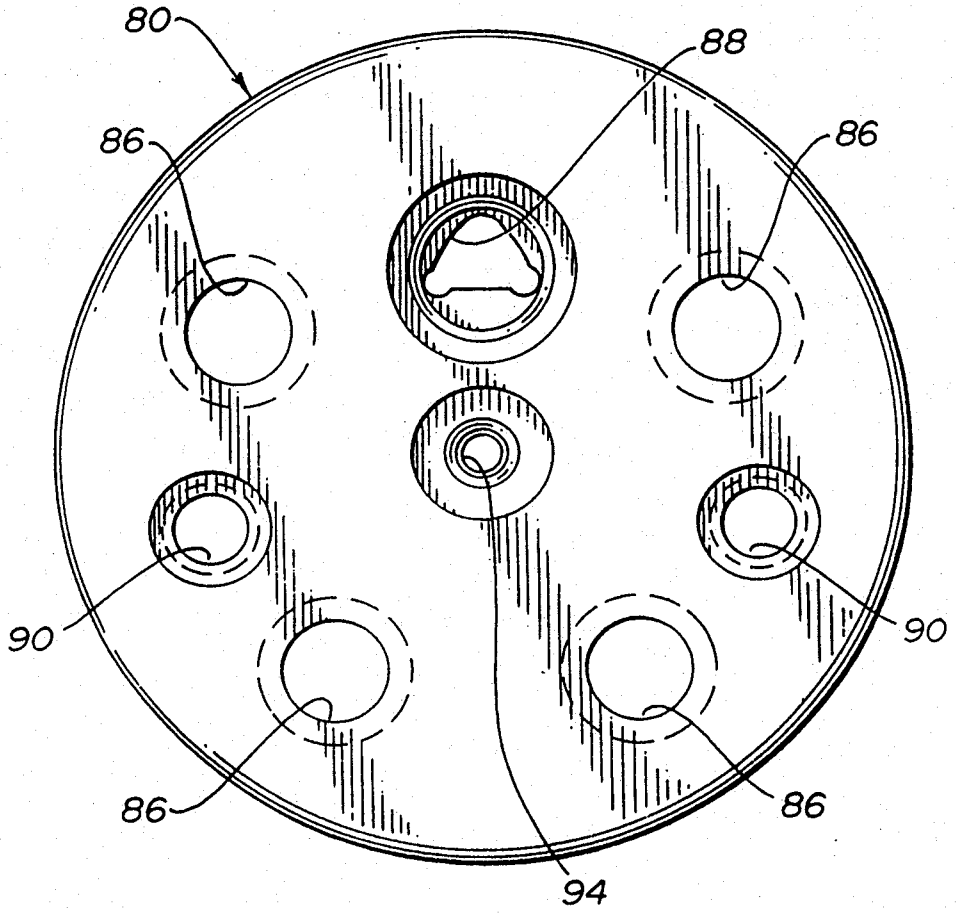
FIG. 5C is a schematic bottom view of the anvil of the present invention.
Figure 5B:
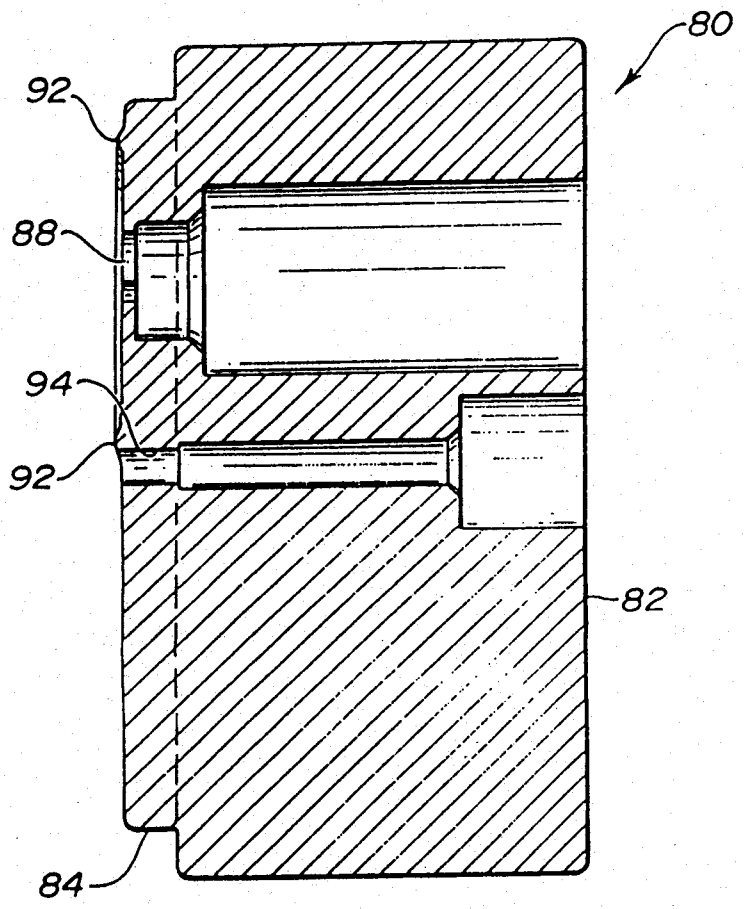
FIG. 5B is a schematic cross-sectional view of the anvil of the present invention taken along line 5—5 of FIG. 5A.
Figure 6:
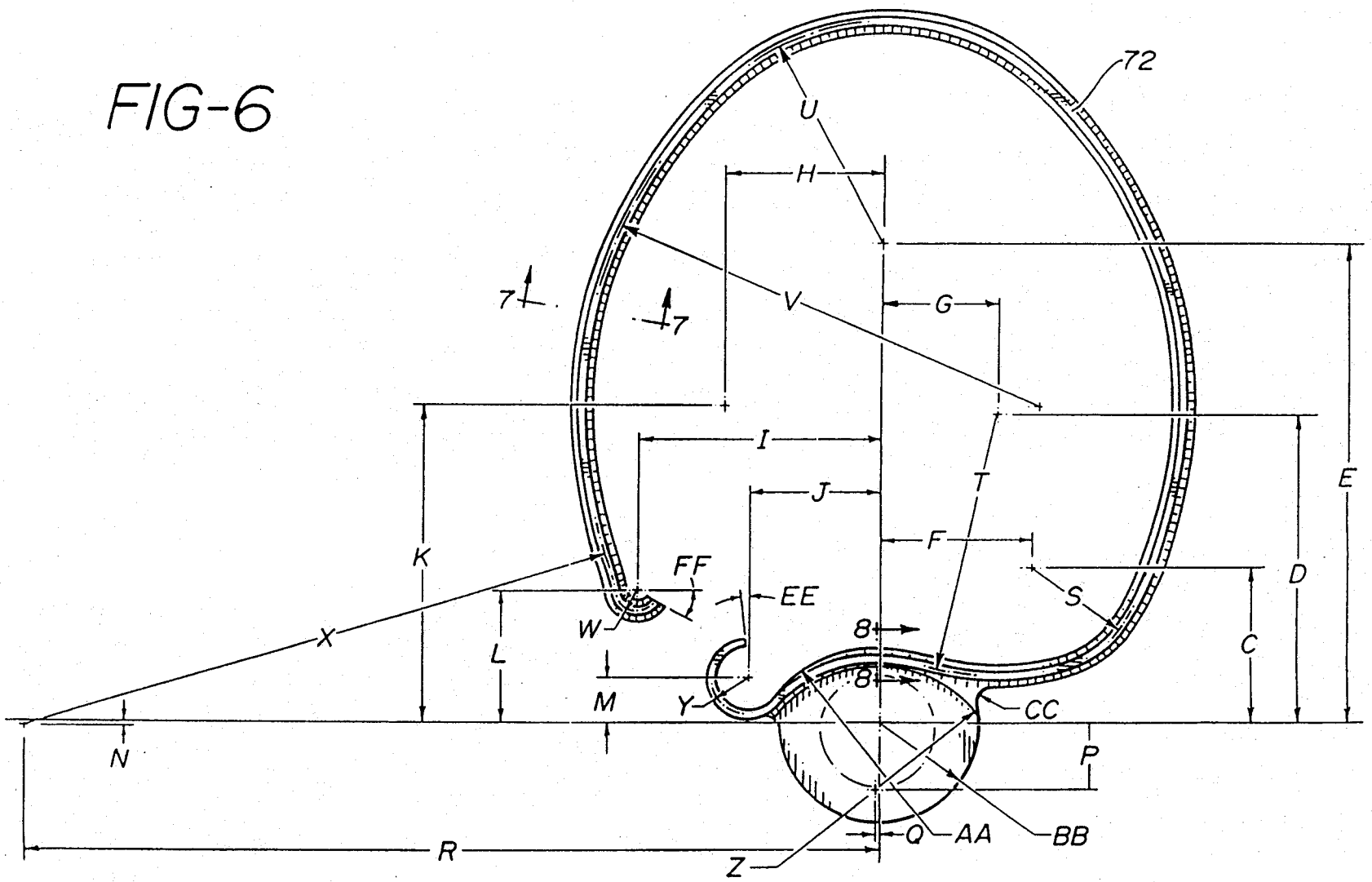
FIG. 6 is an enlarged schematic view of the scoring edge of the present invention.
Figure 7:
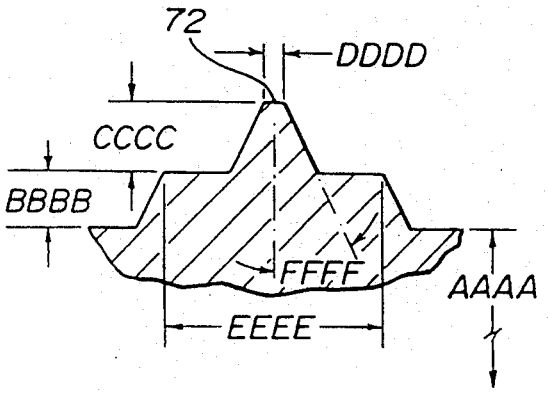
FIG. 7 is a cross-sectional view of the raised scoring edge of the score die at line 7—7 of FIG. 6.
Figure 8:
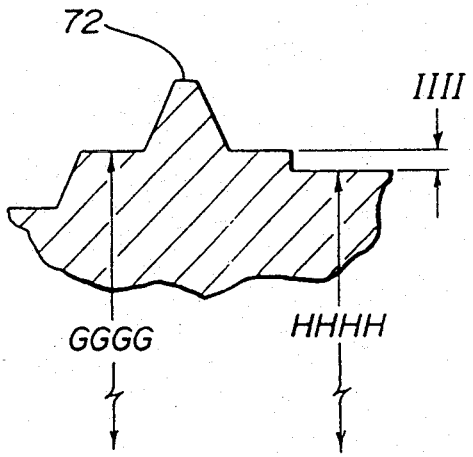
FIG. 8 is a cross-sectional view of the raised scoring edge at line 8—8 of FIG. 6.

The bottom face of score die 60, shown in FIG. 4B, cooperates with the top face of anvil 80, shown in FIG. 5A, to form score line 22 and raised panel area 38 in container end wall 28. Referring to FIGS. 5A–5C, anvil 80, which mates with die 60, is shown. Anvil body 82 has a generally planar face 84 and includes four bolt holes 86 for mounting to means for operating (not shown) as known in the art. Anvil body 82 further includes a raised score line anvil area 92, and a raised area 88 corresponding in shape with raised panel area 38. As shown in FIG. 5c, two anvil alignment holes 90 are provided for insertion of dowels (not shown) used to align anvil 80 on means for operating. Anvil rivet aperture 94 is centrally located in anvil 80 to accommodate rivet 46 which may be inserted in the workpiece. The use of four bolts to secure die 60 and anvil 80 to means for operating, such as a press (not shown), permits bolts of smaller diameter to be used, reducing the amount of material removed by drilling bolt holes, and thereby strengthening die 60 and anvil 80. For example, four ¼ inch diameter bolts may be used instead of three 5/16 inch bolts, requiring less material to be removed to produce the needed bolt holes. The use of four bolts permits more even distribution of pressure across the die face, reducing distortion, and making the score line residual more even and more uniform in depth.

Score die 60 and anvil 80 are preferably comprised of stainless steel and have tolerances and surface finishes as known in the art. Referring to FIGS. 6–11, by way of example, and without limitation of the inventions disclosed herein, preferred dimensions for a beverage can embodiment of the present invention are set forth below. Table 1 includes preferred dimensions for the scoring edge 72 of score die 60 shown in FIGS. 6–8, and Table 2 includes the preferred dimensions for the corresponding raised score line anvil area 92 of anvil 80, shown in FIGS. 9–11.

TABLE 1

| Reference Numeral | Dimension (inches) | Radius (inches) | Angle (Degrees) |
|---|---|---|---|
| O (Rivet aperture) | 0.0000 | | |
| C | 0.1898 | | |
| D | 0.3734 | | |
| E | 0.5805 | | |
| F | 0.1787 | | |
| G | 0.1364 | | |
| H | 0.1850 | | |
| I | 0.2863 | | |
| J | 0.1536 | | |
| K | 0.3840 | | |
| L | 0.1520 | | |
| M | 0.0548 | | |
| N | 0.0045 | | |
| P | 0.0800 | | |
| Q | 0.0027 | | |
| R | 0.0112 | | |
| S | | 0.1276 | |
| T | | 0.3160 | |
| U | | 0.2700 | |
| V | | 0.5399 | |
| W | | 0.0260 | |
| X | | 0.7178 | |
| Y | | 0.0441 | |
| Z | | 0.1478 | |
| AA | | 0.1175 | |
| BB | | 0.1175 | |
| CC | | 0.0200 | |
| DD | | 0.1583 | |
| EE | | | 5 |
| FF | | | 30 37'03" |
| AAAA | 1.0000 | | |
| BBBB | 0.0073 | | |
| CCCC | 0.0047 | | |

TABLE 1-continued

| Reference Numeral | Dimension (inches) | Radius (inches) | Angle (Degrees) |
|---|---|---|---|
| DDDD | 0.0020 | | |
| EEEE | 0.021 ± .001 | | |
| FFFF | | | 25 |
| GGGG | 1.0073 | | |
| HHHH | 1.0053 | | |
| IIII | 0.002 | | |

TABLE 2

| Reference Numeral | Dimension (inches) | Radius (inches) | Angle (Degrees) |
|---|---|---|---|
| O' (Anvil rivet aperture) | 0.0000 | | |
| GG | 0.1898 | | |
| HH | 0.3734 | | |
| II | 0.5805 | | |
| JJ | 0.1850 | | |
| KK | 0.1364 | | |
| LL | 0.1787 | | |
| MM | 0.1536 | | |
| NN | 0.2722 | | |
| OO | 0.2863 | | |
| PP | 0.0548 | | |
| QQ | 0.0800 | | |
| RR | 0.0027 | | |
| SS | 0.0112 | | |
| TT | 0.0045 | | |
| UU | 0.1520 | | |
| VV | 0.2505 | | |
| WW | | 0.3160 | |
| XX | | 0.1276 | |
| YY | | 0.5399 | |
| ZZ | | 0.0636 | |
| AAA | | 0.0260 | |
| BBB | | 0.7178 | |
| CCC | | 0.0441 | |
| DDD | | 0.1583 | |
| EEE | | | 5 |
| FFF | 1.2560 | | |
| GGG | 0.0090 | | |
| HHH | 0.0100 | | |
| III | | | 17 30' |
| JJJ | 0.0010 | | |
| KKK | 0.110 | | |

Figure 10:
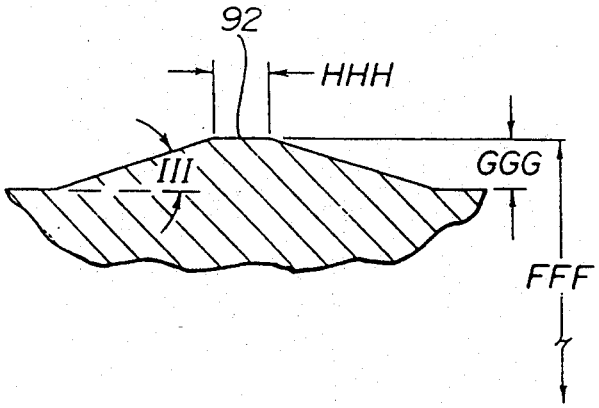
FIG. 10 is a cross-sectional view of the raised score line anvil area at line 10—10 of FIG. 9.
Figure 11:
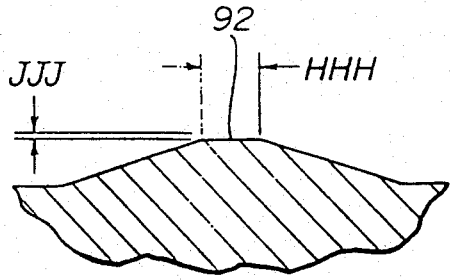
FIG. 11 is a cross-sectional view of the raised score line anvil area at line 11—11 of FIG. 9.
Figure 9:
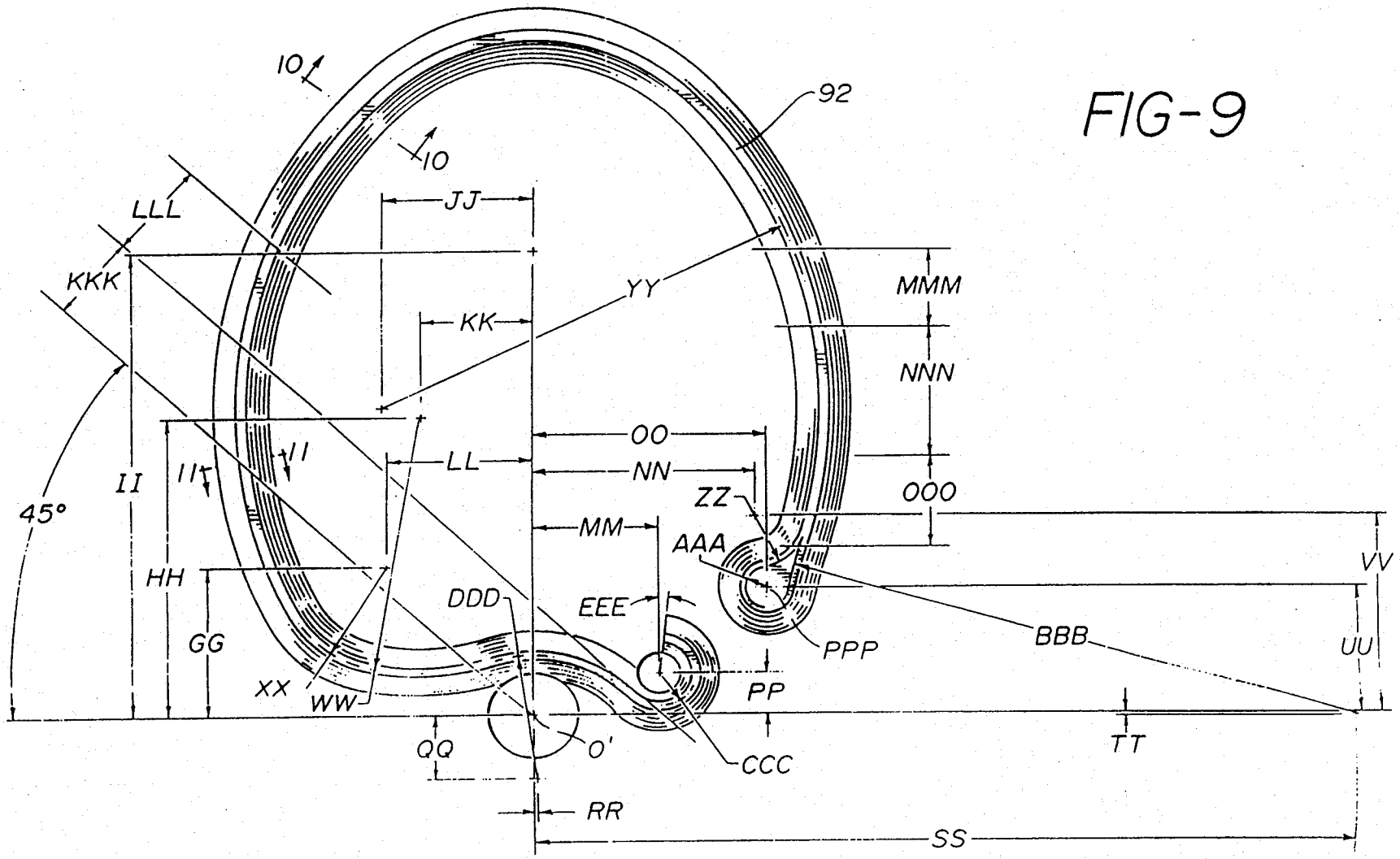
FIG. 9 is a schematic view of the raised score line anvil area on the anvil face of the present invention.

As may be seen in FIGS. 6–11, score depth residual is varied by, preferably, varying the height of raised score line anvil area 92. Such changes may be seen by comparing the cross-sections of FIGS. 10 and 11. The raised score line anvil area 92 varies from the first end thereof, as shown in cross-section in FIG. 11, becoming higher around the end, as shown in FIG. 10. The area again becomes lower approaching its second end, finishing higher. These changes in the height of raised score line anvil area 92, and associated transition areas are summarized in Table 3.

TABLE 3

| Raised Score Line Anvil Area | | | |
|---|---|---|---|
| | | Dimension (inches) | |
| Segment Defined At: | Reference Numeral | Length of Segment | Height of Raised Area |
| Cross-Section 11—11 | FFF-JJJ | | 1.2550 |
| Transition | LLL | 0.120 | 1.2550 to 1.2560 |
| Cross-Section 10—10 | FFF | | 1.2560 |
| Transition | MMM | 0.110 | 1.2560 to 1.2550 |
| Level Area | NNN | 0.160 | 1.2550 |
| Transition | OOO | 0.110 | 1.2550 to 1.2560 |
| Level Area | PPP | | 1.2560 |

It is understood that a higher score line anvil area 92 results in greater score line depth, when die 60 and anvil 80 are brought together to form score line 22. Where deeper score lines are produced, there is correspondingly, less score line residual, and rupture of score line 22 is easier. In the preferred embodiment, aluminum material having 0.001 to 0.001 inches thick is preferred.

While certain representative embodiments and details have been shown for purposes of illustrating the present invention, it will be apparent to those skilled in the art that various changes in the article and apparatus for making disclosed herein may be made without departing from the scope of the invention, which is defined in the appended, claims.

What is claimed is:

1. A score die set for scoring container end walls, adapted for attachment to means for operating said score die set, said score die set comprising:

a score die and a mating anvil;

said score die comprising a die body having a generally planar die face and a raised scoring edge for forming a score line in a container end wall;

said raised scoring edge comprising a curved form to define a displaceable panel in a container end wall and having first and second scoring edge ends separated by a gap to define an unscored hinge area in a container end wall connecting said panel to said end wall, each of said scoring edge ends further including first and second scoring edge tail portions, respectively, said first and second scoring edge tail portion curving inward towards said gap between said first and second scoring edge ends and generally toward the central portion of said curved form.

2. A score die set as recited in claim 1 wherein said score die further comprises one or more grooves in said die face for forming one or more reinforcing beads.

3. A score die set as recited in claim 2 wherein at least a portion of one of said one or more grooves in said score die is disposed substantially adjacent and generally parallel to a segment of said raised scoring edge, including a segment of said scoring edge extending from said second scoring edge tail portion, wherein said portion of one of said grooves is adapted to form a bead and said raised scoring edge is positioned to form a score line in a container wall such that said bead is formed in generally parallel and substantially adjacent relationship to that segment of said score line which extends from a second tail formed by said second scoring edge tail portion.

4. A score die set as recited in claim 2 wherein said mating anvil comprises an anvil body having a substantially planar surface including one or more raised areas corresponding to said one or more grooves.

5. A score die set as recited in claim 4 wherein said mating anvil further comprises an anvil body having a substantially planar surface including a raised score line anvil area corresponding to said scoring edge, and including four bolt holes for attachment to means for operating said die.

6. A score die set as recited in claim 1 wherein said score die further comprises:

a depressed area disposed generally centrally within the die face area enclosed by said scoring edge, said depressed area adapted for forming means for stiffening; and a groove further disposed within said die face area enclosed by said scoring edge, said groove positioned near said scoring edge.

7. A score die set as recited in claim 6 wherein said mating anvil comprises an anvil body having a substantially planar surface including one or more raised areas corresponding to said one or more grooves and to said depressed area.

8. A score die as recited in claim 1 wherein said curved form of said raised scoring edge is generally oval-shaped.

9. A score die set as recited in claim 1 wherein said score die further comprises one or more grooves in said die face for receiving one or more reinforcing beads, wherein at least a portion of one of said one or more grooves in said score die is disposed substantially adjacent and generally parallel to that segment of said raised scoring edge extending from said second scoring edge tail portion, wherein said portion of one of said grooves is positioned to receive a bead and said raised scoring edge is positioned to form a score line in a container end wall, such that said bead is substantially adjacent and generally parallel to that segment of said score line which extends from a second tail formed by said second scoring edge tail portion.

10. A score die set for scoring container end walls, adapted for attachment to means for operating said score die set, said score die set comprising:

a score die and a mating anvil;

said score die comprising a die body having a generally planar die face and a raised scoring edge extending from said die face for forming a score line in a container end wall;

said raised scoring edge comprising a curved form to define a displacable panel in a container end wall and having first and second scoring edge ends for forming said first and second ends of said score line, and wherein:

said first and second scoring edge ends are separated by a gap to define an unscored hinge area in a container end wall connecting said panel to said end wall; and each of said scoring edge ends further includes first and second scoring edge tail portions, respectively, said first and second scoring edge tail portions curving inward towards said gap and generally towards the central portion of said curved form.

11. A score die set as recited in claim 10 wherein said score die further comprises one or more grooves in said die face for receiving one or more reinforcing beads, wherein at least a portion of one or more grooves in said score die is disposed substantially adjacent and generally parallel to that segment of said raised scoring edge extending from said second scoring edge tail portion, wherein said portion of one of said grooves is positioned to receive a bead and said raised scoring edge is positioned to form a score line in a container end wall, such that said bead is substantially adjacent and generally parallel to that segment of said score line which extends from a second tail formed by said second scoring edge tail portion.

* * * * *